US005533605A

United States Patent [19]

Mays et al.

[11] Patent Number: 5,533,605

[45] Date of Patent: Jul. 9, 1996

[54] PAPER CURRENCY HANDLING APPARATUS INCLUDING A CASH BOX SECUREMENT AND ACCESS DEVICE

[75] Inventors: David S. Mays; Robert E. Blevins, both of Mentor, Ohio

[73] Assignee: Diversified Technologies, Inc., North Las Vegas, Nev.

[21] Appl. No.: 456,366

[22] Filed: Jun. 1, 1995

[51] Int. Cl.[6] ..... G07F 7/04

[52] U.S. Cl. ..... 194/206; 232/15

[58] Field of Search ..... 194/206, 207; 232/7, 15, 16; 271/180, 181

[56] References Cited

U.S. PATENT DOCUMENTS

| | | | |
|---|---|---|---|
| 4,434,931 | 3/1984 | Hunt et al. | 232/15 |
| 4,720,092 | 1/1988 | Juleff | 271/207 |
| 4,834,230 | 5/1989 | Kondo et al. | 194/206 |
| 4,949,901 | 8/1990 | Harris | 232/15 |
| 5,129,330 | 7/1992 | McKay et al. | 232/15 X |
| 5,161,736 | 11/1992 | Roccoberton et al. | 232/15 |
| 5,205,481 | 4/1993 | Dekker | 232/16 |
| 5,209,395 | 5/1993 | Zouzoulas et al. | 232/15 |
| 5,344,135 | 9/1994 | Isobe et al. | 271/180 |
| 5,372,361 | 12/1994 | Isobe et al. | 271/181 |

*Primary Examiner*—F. J. Bartuska

*Attorney, Agent, or Firm*—Caesar, Rivise, Bernstein, Cohen & Pokotilow, Ltd.

[57] ABSTRACT

A paper currency handling apparatus including a stacker or cash box, a note acceptor for validating a paper currency banknote inserted into the acceptor, and a transport and punch plate mechanism located within an openable cover of the apparatus for carrying the validated banknote into the stacker box. The stacker box is arranged to securely store a stack of paper currency banknotes therein and is a hollow body having a wall with entrance window located therein through which a validated banknote is introduced by the punch plate of the apparatus. The cash box also includes a releasably securable mechanism for releasably securing the box to the apparatus, and a releasably securable security plate. The security plate is arranged to be oriented in a first orientation and then slid into the box to a sealing position to completely close the window. When in this orientation and position the security plate operates the releasably securable mechanism to enable the cash box to be removed from the apparatus, with the security plate remaining in place completely closing the cash box's window. The cover of the apparatus includes a locking mechanism, which when released, enables the cover to be opened. The release of the cover's locking mechanism is effected by orienting the security plate in a second orientation and sliding it into the cash box to a sealing position, whereupon the security plate completely closes the cash box's window.

18 Claims, 9 Drawing Sheets

THIS SIDE UP
CASH TOR BOX
REMOVAL
10
12
28
30
32
36
38
40
42
44
46
50A
52
60B
92
94
96
98
100
102
104
106
108
110
112
114
116A
118
118A
120
122
124
126
128
130
132
134
136
142
144
146

PAPER CURRENCY HANDLING APPARATUS INCLUDING A CASH BOX SECUREMENT AND ACCESS DEVICE

BACKGROUND OF THE INVENTION

This invention relates generally to apparatus for handling paper currency, and more particularly to secure, stacking cash boxes for use with apparatus for validating paper currency, such as used in the gaming or vending industries.

Gaming or vending apparatus frequently include devices for receiving paper money, validating it, providing it into a secure receptacle, provide a signal to the apparatus, e.g., a slot machine (in the case of the gaming industry), a non-alcoholic beverage vending machine (in the case of the vending industry), etc., of the acceptance of the paper currency.

In particular, prior art currency handling apparatus typically include a cash or "stacker" box for storing a stack of accepted paper currency bills or banknotes therein, a currency validator for checking the validity of a paper bill or banknote inserted into the validator, and a transport mechanism for carrying an accepted bill or banknote from the validator into the cash box or for ejecting a rejected, i.e., non-validated, bill or banknote. The validator typically comprises plural conveyor belts for engaging the longitudinal edges of the inserted bill or banknote to carry it past a plurality of optical and magnetic sensors. The sensors serve to sense various portions of the banknote and to provide electrical signals responsive thereto to associated microprocessor or control means (usually forming a portion of the validator or, in some cases, forming a portion of the apparatus to which the validator is connected) to determine if the banknote is valid, and its denomination. If the banknote is valid, it is transported by the transport mechanism, e.g., a pair of gear-driven belts which also engage the longitudinal peripheral edges of the banknote, into a waiting cash box.

The mechanism for carrying the accepted bill or banknote into the cash box is commonly referred to as a "punch" or "pusher" plate, and may form a portion of the transport mechanism of the stacker apparatus, or may form a portion of the cash box itself.

In the later case the cash box is necessarily somewhat complex and expensive. In either case, prior art cash boxes frequently include a window or opening in a wall thereof through which the currency bill or banknote is introduced for stacking therein. If the punch plate is located in the apparatus, and not in the cash box itself, the window through which the banknote is pushed or punched is quite large, i.e., as long as the banknote, but of a slightly lesser width.

When the cash box is full, i.e., the stack of bills therein reaches a predetermined amount, it is removed from the stacking apparatus, the currency removed therefrom, and then it is remounted to the stacking apparatus for reuse.

In the gaming industry, where security is of paramount concern, it is a typical practice to remove the full cash box to some secure location before its currency contents are emptied. Thus, prior art cash boxes having large windows for passage of the banknotes therethrough typically include some locking means to seal or close that window when the cash box is removed from the stacker apparatus to ensure that access cannot be gained through the window to the interior of the cash box. The locking means employed by such prior art devices is frequently quite complex, e.g., a foldable multi-section, gear-driven door, which necessarily increases the costs of such cash boxes. While such prior art cash boxes may provide sufficient security to prevent access to their interior once they have been removed from the apparatus which they had been servicing, they are not very durable, and hence are subject to damage by impact, thereby possibly rendering them inoperative.

In addition to the foregoing some prior art cash boxes may not provide sufficient security to prevent access to their interior if the stacker apparatus to which they are mounted needs to be opened for some reason leaving the cash box in place. Such action could occur during servicing of the transport path to clear a paper bill or banknote which is jammed therein.

Examples prior art paper currency handling and/or storage apparatus are shown in the following U.S. Pat. Nos.: 4,434,931 (Hunt et al.), 4,720,092 (Juleff), 4,834,230 (Kondo), 4,949,901 (Harris), 5,129,330 (McKay et al.), 5,161,736 (Roccoberton et al.), 5,205,481 (Dekker), 5,209,395 (Zouzoulas), 5,344,135 (Isobe et al.), and 5,372,361 (Isobe et al.).

A need thus exists for a cash box and a paper currency handling apparatus using the same which is simple in construction and relatively low in cost. A need also exists for a cash box to provide sufficient security for its contents, whether it is in place within a paper currency handling apparatus, or is removed therefrom.

OBJECTS OF THE INVENTION

Accordingly, it is a general object of this invention to provide a secure cash box and an apparatus utilizing the cash box which meet those needs and which overcomes the disadvantages of the prior art.

It is another object of this invention to provide a cash box for releasable mounting to a paper currency handling apparatus to receive a stack of paper currency banknotes therein, and to maintain that stack secure from pilferage whether the cash box is mounted to the apparatus or is removed therefrom.

It is still another object of this invention to provide a cash box for receipt of a stack of paper currency banknotes, and a releasably securable security plate for sealing the cash box to prevent unauthorized access to those banknotes.

It is yet another object of this invention to provide a secure cash box for receipt of a stack of paper currency banknotes therein which is simple in construction and low in cost.

It is yet another object of this invention to provide a security plate for releasably sealing an opening in a cash box to prevent unauthorized access to a stack of paper currency banknotes therein.

SUMMARY OF THE INVENTION

These and other objects of this invention are achieved by providing a secure currency cash or stacker box for releasable mounting to paper currency handling apparatus.

The paper currency handling apparatus includes note acceptor means for validating a paper currency banknote inserted therein, and transport means and punch plate means located within an openable cover for carrying the validated banknote into the cash box. The cash box is arranged to securely store a stack of paper currency banknotes therein.

The cash box comprises a hollow member having a wall with entrance window located therein through which a validated banknote is introduced by the punch plate of the apparatus, releasable securement means for releasably securing the box to the apparatus, and a releasably securable security plate.

The security plate is arranged to be oriented in a first orientation and then slid into the box to a sealing position to completely close the cash box's window. The security plate when in the first orientation and sealing position cooperates with the releasable securement means to enable the cash box to be removed from the apparatus, with said security plate remaining in place completely closing the cash box's window. If the security plate is not slid within the box in the first orientation to the sealing position to close the window, the cash box cannot be removed from the apparatus.

In accordance with one preferred aspect of this invention the apparatus includes locking means coupled to the openable cover, and which when released enables the cover to be opened. The release of the locking means is effected by orienting the security plate in a second orientation and sliding it into the cash box to the sealing position, whereupon the security plate completely closes the cash box's window. With the security plate in the second orientation and in the sealing position the security plate cooperates with the locking means to enable the cover to be opened, but with the security plate remaining in place completely closing the window.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
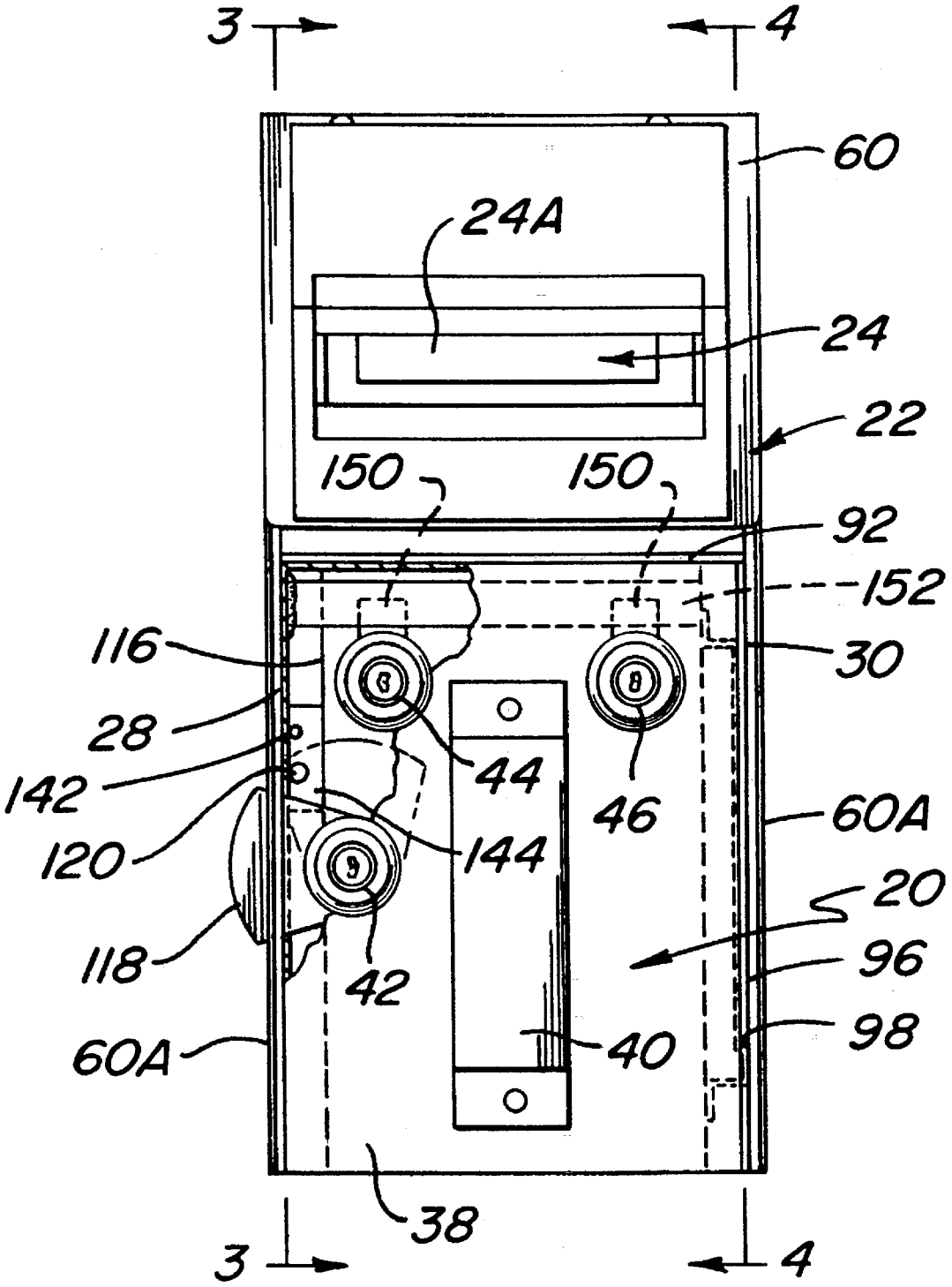
FIG. 1 is a front elevational view of a paper currency handling apparatus constructed in accordance with this invention.

Referring now to various figures of the drawing where like reference numerals refer to like parts there is shown at 20 in FIG. 1, a secure cash or stacker box for use in a stacker apparatus 22 for handling paper currency bills or banknotes also constructed in accordance with this invention.

The stacker box 20 is arranged to be releasably mounted in the apparatus 22. That apparatus can form a portion of any suitable machine, e.g., a slot machine, a vending machine, etc. The apparatus 22 basically comprises a bill acceptor or validator 24 and an associated paper currency transporting mechanism 26. The bill acceptor can be of any conventional construction. One particularly suitable bill acceptor is constructed in accordance with the teachings of our co-pending patent application, Ser. No. 08/454,997, filed on May 31, 1995, entitled Universal Currency Acceptor, which is assigned to the same assignee as this invention, and whose disclosure is incorporated by reference herein.

It should be pointed out that while the apparatus 22 shown herein is in the form of a horizontal down-stacking gaming stacker, that embodiment is merely exemplary. Thus, the apparatus 22 can be in the form of a horizontal up-stacking gaming stacker, or a vertical gaming stacker.

The security cash box 20, basically comprises a hollow housing or shell 10 and an associated cash box security plate 12 arranged to be releasably secured to the shell. The shell 10 is formed of any suitable, strong material, e.g., steel, and has a hollow interior arranged to receive and hold a plurality of paper currency banknotes 50A which are provided from the bill validator 24 by the transporting mechanism 26.

The details of the security cash box 20 will be set forth hereinafter. Suffice it for now to state that the outer shell of the cash box comprises a pair of exterior side walls 28 and 30, an exterior rear wall 32, an exterior bottom wall 34, and an exterior top wall 36. The front of the cash box does not include any wall. Rather it includes a pivotable, lockable front door 38. The front door 38 has a handle 40 fixedly secured thereto. A cash box lock 42 for locking the cash box to the apparatus 22 is provided on the door 38. A pair of currency removal locks 44 and 46 for locking the door to preclude access to the interior of the cash box are provided on the door. The cash box door 38 is hinged at its bottom by a hinge 48 (FIG. 4) and is arranged to be pivoted open, i.e., downward, by unlocking both the currency removal locks 44 and 46, whereupon access to a stack 50 of bank notes 50A inside the cash box can be had. The cash box lock 42 cooperates with a latching means in the cash box (to be described later) to releasably secure the cash box to a portion of the housing forming the stacker apparatus 22.

Figure 2:
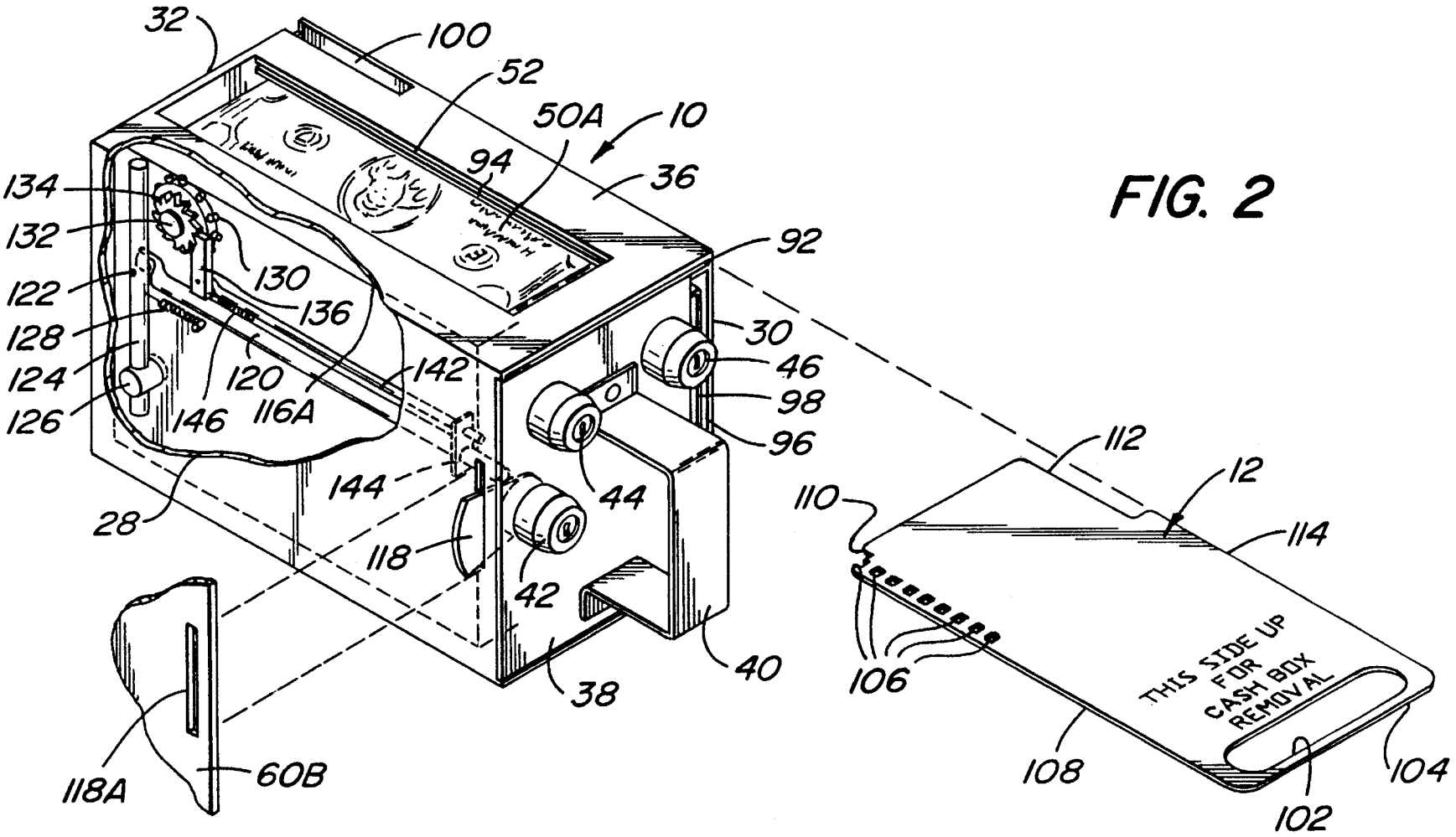
FIG. 2 is an enlarged, exploded isometric view, partially in section, of a secure stacker or cash box and a security plate constructed in accordance with this invention and forming a portion of the apparatus shown in FIG. 1.

As best seen in FIG. 2, the top wall 36 of the cash box includes an entrance opening or window 52 through which the plural banknotes 50A are "punched" or pushed by portion of the transporting mechanism. The specific means for pushing the banknote through the window and into the interior of the cash box comprises a "punch plate" (to be described later). The punch plate forms a portion of the transporting mechanism 26 and is disposed over the cash box's window 52 when the cash box is locked in place in the stacker apparatus 22.

As is conventional the width of the cash box's window 52 is slightly less than the width of the banknotes 50A to be stacked within the cash box, so that once they are punched through the window by the punch plate they cannot accidently pop out of the cash box.

The paper currency banknotes are validated and transported to the cash box in a somewhat conventional manner. In this regard, a paper currency banknote 50A is introduced into the entrance port 24A of the bill acceptor 24. The bill acceptor includes a pair of motor-driven drive belts 54 (FIG. 3), each of which engages a respective peripheral edge of the banknote 50A to carry the banknote down a path in the validator past plural internal sensors (not shown) to an "escrow" position in the apparatus 22 where the bank note is held temporarily. The sensors of the validator in conjunction with a microprocessor (not shown) forming a portion of the electronics 200 of the apparatus 22 determine whether or not the banknote is genuine, and its denomination. If the banknote is not genuine, the belts are driven in the reverse direction so that the banknote is ejected from the bill validator 24. If, however, the banknote is determined to be valid, it is "accepted" and carried by an associated pair of narrow drive belts 56 (to be described later) of the transporting mechanism 26 down a path to a "punch" plate 58. The transporting mechanism is located within a pivotable cover 60 of the housing 60A of the stacker apparatus 22. The housing 60A is supported on a frame 60B. The bill acceptor 24 is mounted in the front of the cover 60A. The cover 60A is pivotable with respect to the frame 60B and the housing 60A to provide access to the bill validation path, e.g., the transporting mechanism and punch plate. Those means are fixedly supported on the apparatus frame 60B.

Figure 3:
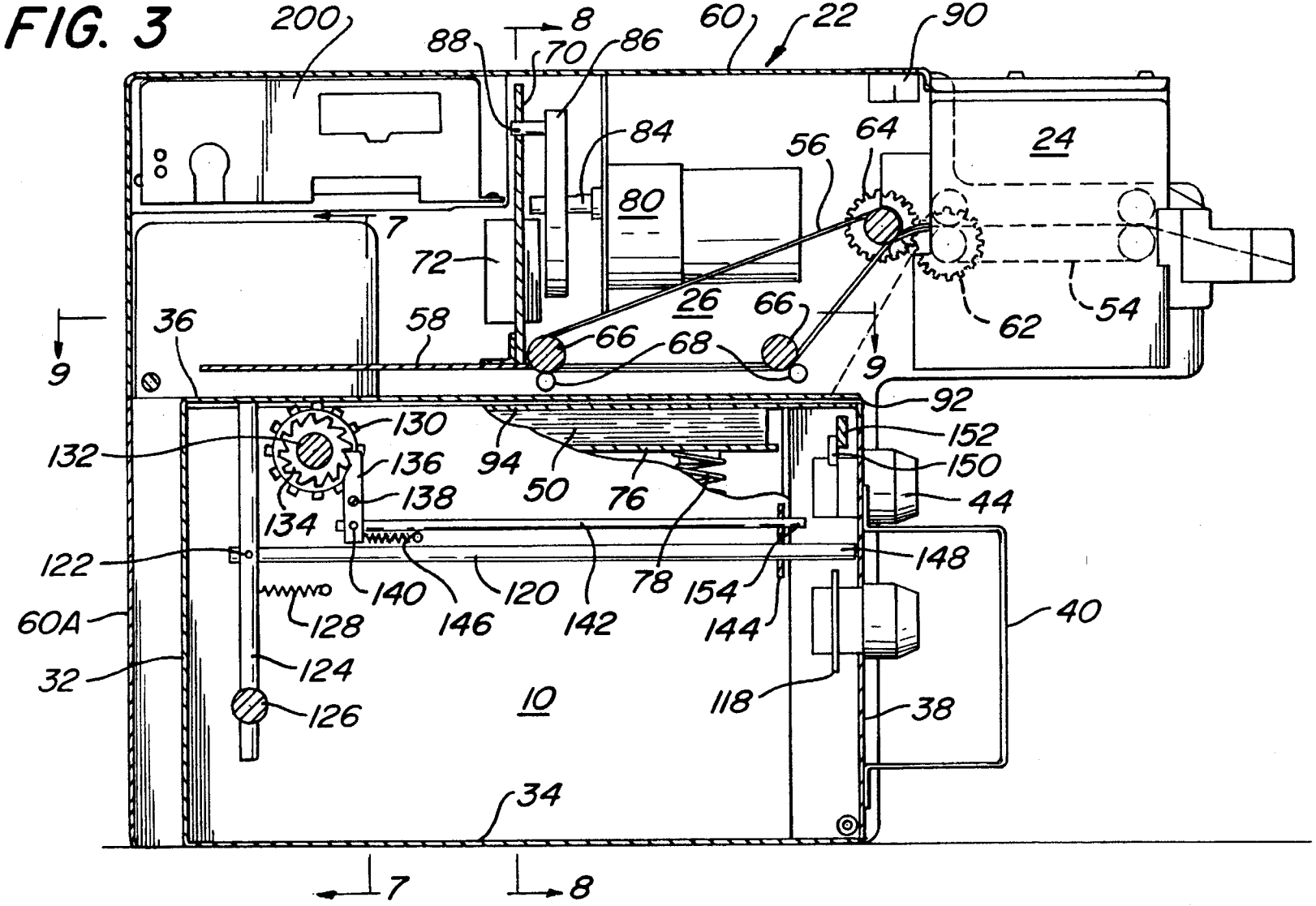
FIG. 3 is an enlarged, sectional view taken along line 3—3 of FIG. 1.

As is conventional, the bill acceptor or validator includes a motor (not shown) for driving an associated gear 62 which drives the validator transporting belts 54. The gear 62 also engages an associated gear 64 in the transport mechanism 26. The gear 64 drives a roller about which the drive belts 56 extend. The drive belts 56 are narrow in width and extend in respective grooves in a pair of bottom rollers 66. A pair of idler rollers 68 are disposed immediately below the belts 56 and the rollers 66 to establish a horizontal, banknote carrying path (FIG. 3). In particular the banknote from the bill acceptor 24 is carried between the belts 56 and the idler rollers 68 to a position immediately in front, i.e., below, the punch plate 58. Each of the belts is formed of a resilient material for frictionally engaging a respective peripheral longitudinal edge of the banknote to be transported thereby to carry the banknote to the front of the punch plate 58.

The punch plate basically comprises a rectangular metal plate mounted on a vertically extending mounting bar 70. The mounting bar is supported by an opposed pair of Teflon® material guide members 72 so that it can be reciprocated up and down. The guide members are fixedly mounted to opposite sides of the apparatus frame 60B via plural screws. The reciprocation of the punch plate mounting bar causes the punch plate to engage the banknote 50A which has been carried beneath it by the belts 56 to push the banknote out of engagement with those belts and idler rollers. The width of the punch plate is less than the spacing between the belts 56 so that when the punch plate engages the banknote it clears the belts to push the banknote into the window 52 in the top wall of the cash box.

Figure 8:
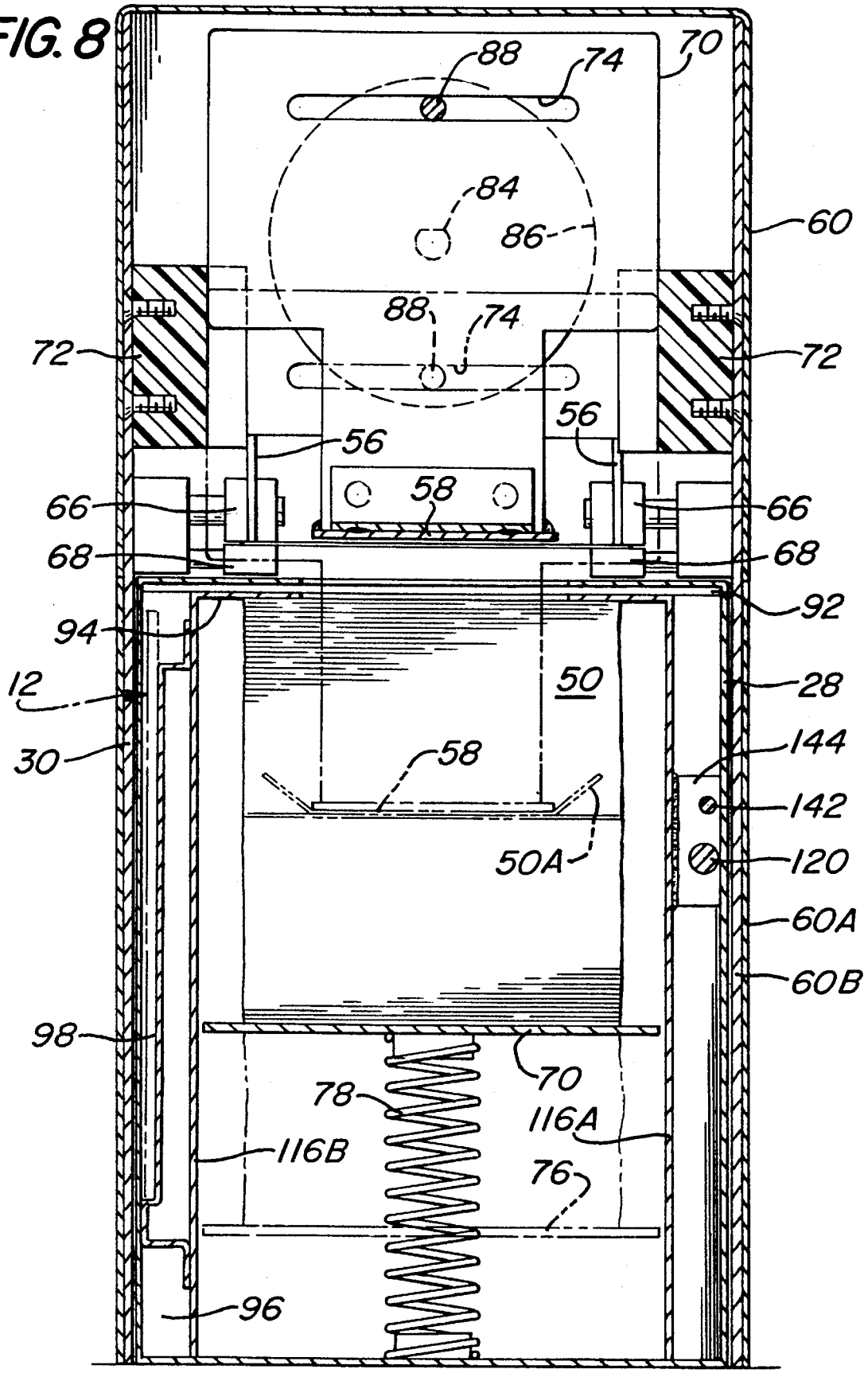
FIG. 8 is an enlarged sectional view taken along line 8—8 of FIG. 3.
Figure 9:
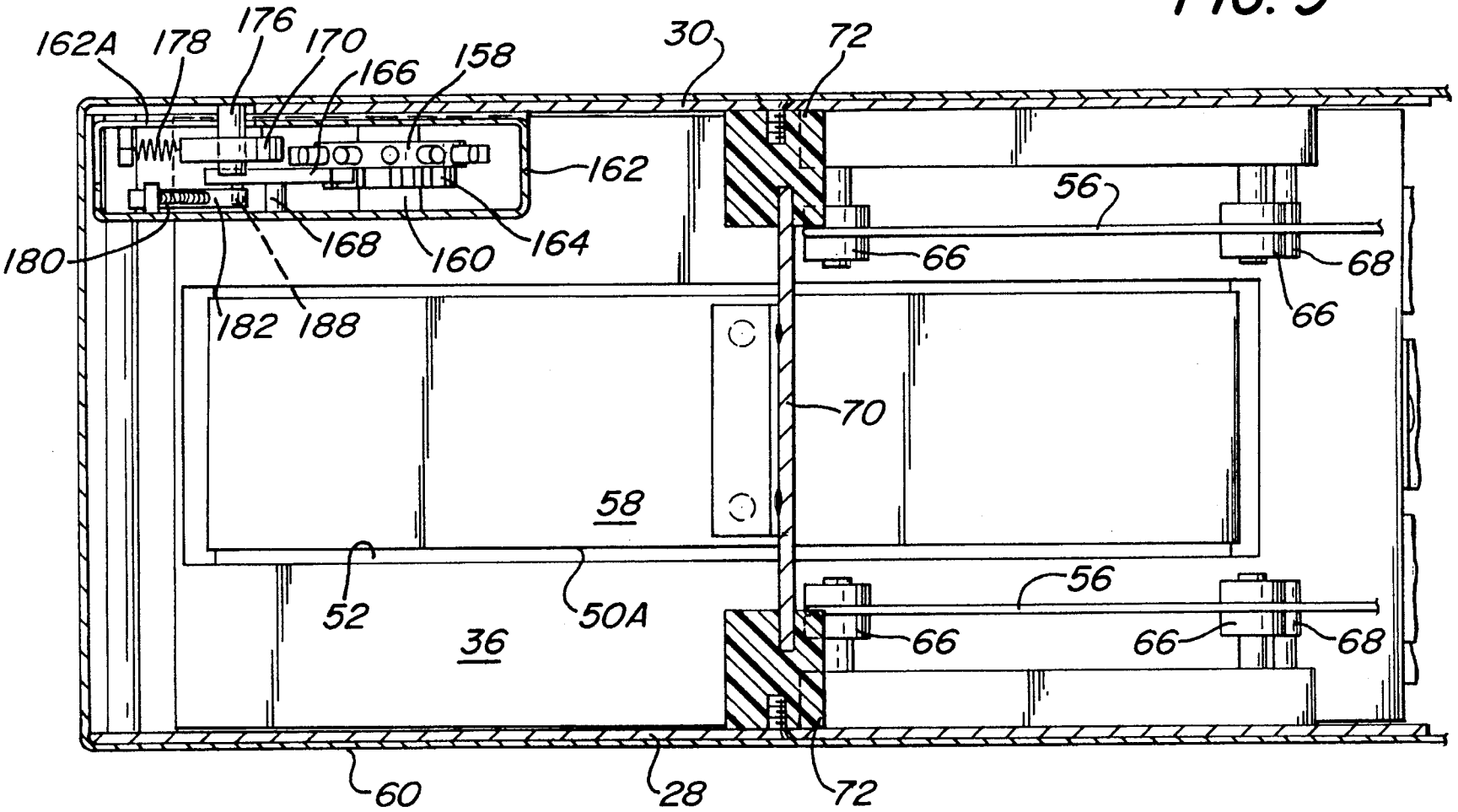
FIG. 9 is an enlarged sectional view taken along line 9—9 of FIG. 3.

As can be seen clearly in FIG. 8, the width of the punch plate 58 is slightly less than the width of the window and is substantially less than the width of the banknote 50A. Accordingly, as the punch plate pushes the banknote through the window, the edges of the banknote bend slightly as shown by the phantom lines in FIG. 8. Once the banknote is within the interior of the cash box it automatically flattens out and forms the top bill or banknote in the stack 50. The stack 50 of banknotes is supported on a bill receiving plate 76 located within the interior of the cash box. The bill receiving plate 76 is biased upward by a pair of bias springs 78.

The operation of the punch plate is accomplished by a motor 80 and an associated transmission in the transport mechanism 26. In particular, as can be seen in FIGS. 3 and 8 the motor 80 includes a rotary output drive shaft 84 on which a rotary-to-linear transmission is mounted. The transmission is in the form of a wheel 86 centrally mounted on the motor's output shaft. The wheel includes an offset pin 88 at a position closely adjacent its periphery. The pin 88 extends into an associated horizontal slot 74 in the punch plate mounting bar 70. The punch plate mounting bar, as noted earlier, is held in the vertical orientation by the heretofore mentioned guide members 72 but can be slid therealong either upward or downward. Operation of the motor causes the rotation of the wheel 86 to convert the rotary motion of the motor's output shaft into a reciprocating motion of the punch plate mounting bar, and of the punch plate itself.

The cash box 20 is arranged to be releasably mounted within the housing 60A of the stacker apparatus 22 immediately below the punch plate 58 so that when the cash box is locked in place one cannot gain access to the interior of the cash box.

In accordance with one aspect of this invention, the security plate 12 is provided to completely close the currency window 52 in the cash box to enable the cash box to be removed from the stacker apparatus 22, thereby preventing theft of bills through the window. The security plate 12 operates in conjunction with a locking mechanism, to be described later, within the cash box to enable the cash box lock 42 to be unlocked from the apparatus housing 60A when the security plate is fully in place covering the currency entrance window 52. Accordingly, the cash box cannot be removed from the stacker apparatus 22, i.e., the lock 42 cannot be unlocked, until the security plate is fully in place in a sealing position closing the window 52.

In order to close the window, the security plate 12 is oriented in a first orientation and then slid through a slot (to be described later) in the cash box and which is located under the window until it completely closes or seals that window. This is what will be referred to as the "sealing" position.

The location of the security plate in the sealing position and in the first orientation also locks the security plate in place with respect to the cash box so that it cannot be removed therefrom. In particular, once the security plate is in place, the cash box lock 42 can be unlocked from the housing 60A and the cash box removed from the stacker apparatus 22. The cash box can then be taken to a secure location, whereupon the currency removal locks 44 and 46 can be unlocked by authorized personnel so that the front door of the cash box can be pivoted downward to provide access to the stack 50 of banknotes 50A within the cash box.

Once the cash box has been emptied of its paper currency, it can be replaced into the stacker apparatus 22 for reuse. To that end, and as will be described later, before the cash box is reinserted into the stacker apparatus, the security plate 12 is removed from its "sealing" position and put into a convenient storage slot (to be described later) located in the side of the cash box. The cash box is then slid into the housing 60A between portions of the frame 60B until its back wall 32 is immediately adjacent the back wall portion of the housing 60A as shown in FIG. 3. A portion of the locking mechanism (to be described later) is then released to enable the pivotably door 38 to be closed and the cash box lock to be actuated by an appropriate key to lock the cash box in place in the apparatus 22. The cash box locks are then relocked to seal the front door in the closed position. The cash box is now ready to accept additional banknotes.

The cash box 20 and the security plate 12 of the subject invention also are arranged cooperate with each other to enable an operator of the stacker apparatus 22 to gain access to the bill transport mechanism or punch plate for servicing while precluding access to the interior of the cash box. This action is frequently necessary for routine servicing or in the event that a paper banknote becomes jammed in the transport mechanism. In this regard, and as will be described in detail later, if it is desired to open the note path access cover 60 of the stacker apparatus 22, i.e., to pivot the cover up with respect to the frame 60B and the remainder of the housing 60A, before such action can be accomplished the security plate 12 must be utilized to seal the cash box window 52. Thus, the security plate 12 is removed from its storage location in the cash box and is then oriented into a second orientation (to be described later). Once in that orientation the security plate is inserted into the slot in the cash box under the window 52 to the "sealing" position, i.e., the position completely closing the window 52. At the same time that the window 52 in the cash box is sealed or closed by the security plate, another locking mechanism (to be described later) mounted on the frame 60B under the note path access cover 60 is released. The release of this locking mechanism releases a latch component thereof so that the cover 60 can be pivoted up. However, before the cover 60 can be pivoted up, a manual latch 90 in the top of the cover has to be unlatched.

When the cover 60 is pivoted up, access to the transport mechanism 26 is readily provided. Thus, any banknote or bill in that mechanism which has become jammed can be readily removed. Since the security plate completely covers or seals the window 52 in cash box, complete security to the contents of the cash box is maintained. That is, one cannot gain access to the currency banknotes within the cash box via the now opened note path access cover 60.

After the jammed bill has been cleared, the cover 60 is then pivoted downward, whereupon the latching mechanism automatically locks the cover 60 in the closed position and enables the security plate 12 to be removed from the cash box. The removal of the security plate reopens the cash box window 52 to enable bills to be punched into the cash box during subsequent operation of the apparatus 22.

As mentioned earlier, the cash box includes a slot for receipt of the security plate to seal or close the window. This access slot, designated by the reference 92, is best seen in FIGS. 1–4 and is located immediately over the top edge of the front door 38 and extends fully under the top wall 36 of the cash box. The slot is formed by a pair of flanges 94 extending inwardly from a pair of interior or partition walls 116A and 116B. The walls 116A and 116B are located closely adjacent exterior walls 28 and 30, respectively. The flanges 94 are located closely below the top wall 36 with their peripheral edge being immediately adjacent the sides of the window 52.

As also mentioned earlier, the security plate 12 is normally stored within a storage slot in the cash box until it is ready to be used to seal the window. That storage slot is designated by the reference number 96 and is located between the side wall 30 and the interior partition wall 116B wall on one side of the cash box. A clip 98 (FIG. 8) is disposed within the slot 96 to frictionally hold the security plate 12 in place between it and exterior wall 30. This prevents against accidental removal of the security plate.

As can be seen clearly in FIG. 2, an access slot 100 is provided in the top wall 36 of the cash box 20 adjacent to the intersection of the side wall 30 and rear wall 32. This slot operates in conjunction with the security plate 12 and the latching mechanism in the apparatus 22 to preclude opening of the cover 60A until the security plate is in place in the second orientation sealing the window of the cash box.

Figure 4:
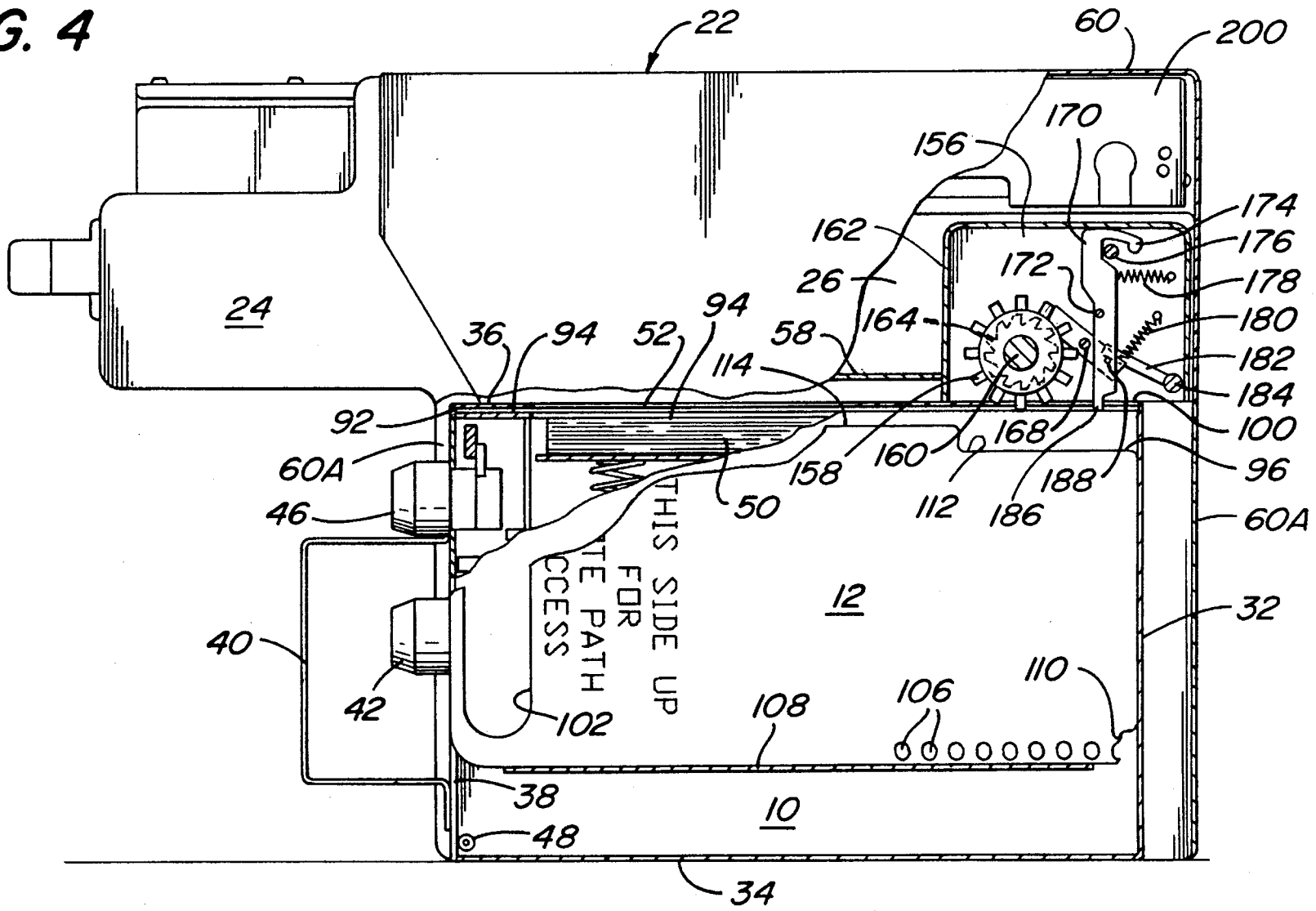
FIG. 4 is an enlarged, sectional view taken along line 4—4 of FIG. 1.

Referring now to FIGS. 2 and 4, the details of the security plate 12 will now be considered. That plate basically comprises a planar sheet formed of any suitable strong, material, e.g., steel. The plate is of generally rectangular shape and includes an elongated slot having arcuate ends located adjacent one end to serve as a handle 104 for enabling the security plate to be readily removed from its storage slot 96 or from the cash box's window sealing access slot 92. A plurality of square apertures 106 are located along one marginal edge 108 of the plate at the opposite end of the plate from the handle 104. A small notch 110 is located at the far end of the plate contiguous with the first aperture 106. A longer notch 112 is located at the far end of the security plate on the opposite edge 114.

As mentioned earlier, the security plate 12 is arranged to be utilized to either permit the removal of the cash box from the stacker apparatus (while closing off the window 52 in the top wall of the cash box), or to enable the opening of the note path access cover 60 of the stacker apparatus to provide access to the transport mechanism (while also closing off the window 52).

The cash box removal action is effected by orienting the security plate 12 in the orientation shown in FIG. 2, that is, with the apertures 106 located to the left. Indicia in the form of a legend stating "This Side Up For Cash Box Removal" is provided on the security plate adjacent the handle 104 to be readily visible when the security plate is in the desired first orientation for removal of the cash box from the apparatus 22. The security plate is arranged to be flipped over or inverted so that the plural apertures 106 are on the right to enable the security plate to be used to release the latch mechanism holding the note path access cover in the closed position. Instructional indicia are provided on the opposite side of the security plate immediately adjacent the handle to indicate this second orientation. That indicia comprises the legend "This Side Up For Note Path Access." When this legend is facing upward, the plural apertures 106 are on the right so that they will be located under the slot 100 when the security plate is in place, as will be described later.

When the security plate 12 is in the first orientation shown in FIG. 2 so that the legend "This Side Up For Cash Box Removal" is visible, the plural apertures 106 are arranged to engage the latching mechanism located within the cash box to prevent the removal of the security plate once it has been slid or introduced to a predetermined position within the access slot 92.

In FIG. 3 the cash box is shown in the position wherein it is locked to the stacker apparatus by the cash box lock 42. When the cash box is locked to the stacker apparatus the security plate is stored in the storage slot 96. Thus, the window 52 in the top wall of the cash box is completely open to enable banknotes 50A to be punched therethrough by the punch plate. In FIG. 4 the opposite side of the stacker apparatus is shown with the cash box locked in place and the security plate held in the storage position within the storage slot 96. When the cash box is in this position, the note path cover locking mechanism (to be described later) is operative to prevent lifting or pivoting of the cover 60 even if the manual latch 90 of the cover is opened. The details of this locking mechanism will be described later. Suffice it for now to state that when the security plate 12 is inserted in the access slot 92 with the apertures to the right, those apertures engage a portion of the locking mechanism to effect the release thereof, thereby enabling the note path access cover 60 to be pivoted upward from the housing 60A. As mentioned earlier, the release of the note path access cover is only effected after window 52 in the top wall of the cash box has been completely sealed by the security plate 12.

In FIGS. 2, 3, 5 and 7 there is shown the latching mechanism for locking the security plate 12 in place to close the window 52 in the top wall of the cash box to permit the removal of the cash box from the stacker apparatus. That latching mechanism will now be described.

In particular, the latch mechanism for preventing the removal of the cash box from the apparatus is located within an interior compartment between the partition wall 116A and the exterior wall 28. The latching mechanism within the compartment is arranged to cooperate with a cam 118 on the cash box lock to prevent the lock from being rotated to an unlocked position when the cash box window 52 is open. The cam 118 is arranged to extend into a slot 118A (FIG. 2) in the housing 60B to lock the cash box to the apparatus 22. When the cam 118 is retracted out of the slot 118A, the cash box can be pulled out of the apparatus 22 (as will be described later).

The latching mechanism basically comprises a lock shaft 120 and associated components. The lock shaft serves to block the rotation of the cam 118 so that when the cam is within the slot 118 in the housing 60A it is prevented from being retracted (i.e., pivoted) out of that slot by the lock shaft. Thus, the cash box cannot be removed from the stacker apparatus 22 (i.e., its lock 42 cannot be rotated). However, as will be described in the detailed description to follow, when the security plate 12 is inserted into the access slot 92 to the sealing position fully closing the window 52, the latching mechanism is operated to effect the retraction of the lock shaft 120 from the position shown in FIG. 3 to the position shown in FIG. 5. This action releases the cam 118 of the cash box lock 42. Accordingly, the cash box lock can then be rotated to pivot the cam 118 out of the slot 118A in the stacker apparatus housing 60A so that the cash box can be withdrawn or removed therefrom by pulling on the cash box handle 40.

Figure 5:
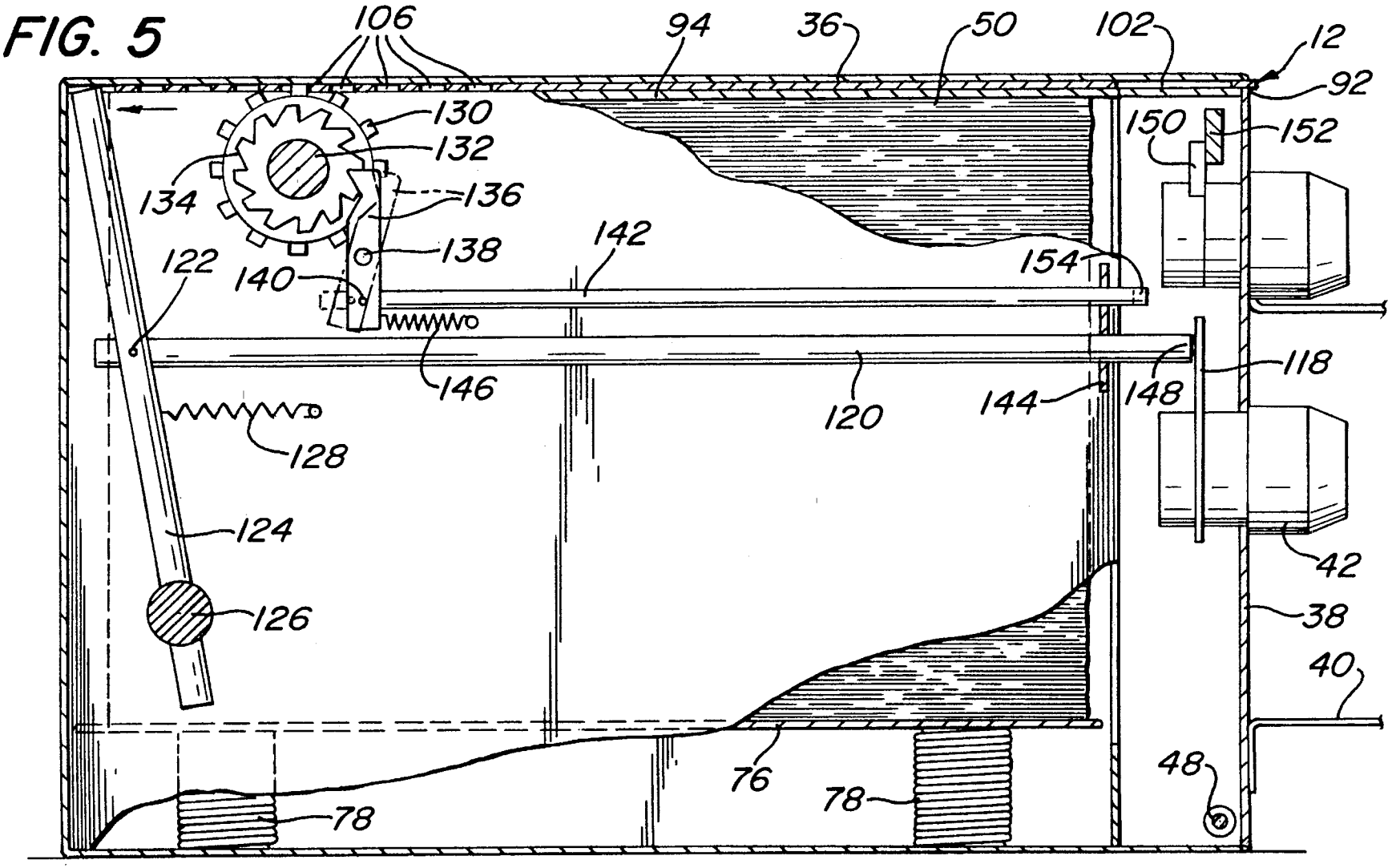
FIG. 5 is an enlarged, vertical sectional view of the cash box shown in FIG. 2.

As can be seen clearly in FIGS. 2, 3 and 5 the lock shaft 120 comprises an elongated member whose far end includes a pin 122 connected to an elongated trip shaft lever 124. The trip shaft lever is mounted on the partition wall 116A via a pivot 126. The portion of the trip shaft lever 124 below the pin is connected via a tension spring 128 to the partition wall 116A. The upper or free end of the trip shaft lever extends into the security plate access slot 92 at the end thereof. A toothed wheel or gear 130 is located within the locking mechanism compartment and is rotably mounted on a shaft 132 extending between the partition wall 116A and the exterior wall 28. An associated ratchet 134, having plural cam teeth and associated grooves, extends about the shaft 132 and is fixedly secured to the shaft and to the gear. A locking mechanism pawl 136 is mounted on a pivot pin 138 extending from the inside surface of the partition wall 116A. The lower end of the pawl includes a pin 140 which is coupled to one end of a elongated security bar shaft 142. The other end of the security bar shaft 142 extends through an opening or hole in a guide support 144 mounted on the partition wall 116A. The lock shaft 120 also extends through an opening or a hole in the guide support 144. A tension or bias spring 146 is connected between the bottom portion of the pawl 136 and a pin on the inner surface of the partition wall 116A to hold the pawl in the position shown by the solid lines in FIGS. 3 and 5. When the pawl is in this position, the gear 130 is precluded from rotating in the clockwise direction, but is free to rotate in the counterclockwise direction.

In order to release the cash box from the stacker apparatus 22, the security plate 12 is removed from its storage slot 96 in the side of the cash box and oriented to the "first" orientation shown in FIG. 2. The security plate is then inserted in that orientation into the security plate access slot 92 and slid therealong. In particular, the user pushes the security plate 12 down the security plate access slot 92 as far as it will go. As the first of the plural apertures 106 on the marginal edge of the security plate 12 engage the closest of the teeth on the gear 130, the gear begins to rotate in the clockwise direction. As the security plate 12 is forced deeper and deeper into the access slot 92 successive apertures 106 engage successive teeth of the gear 130, thereby further rotating the gear in the clockwise direction. As each succeeding aperture receives a respective tooth, the gear rotates through an arc, whereupon the pawl 136 slides over an associated rachet tooth into the next notch in the rachet. By virtue of the pawl being received in a notch in the ratchet, the gear 130 is precluded from being rotated in the clockwise direction. Thus, once the first one of the apertures 106 engages a tooth of the gear 130, the security plate 12 cannot be pulled out of the access slot 92.

When the security plate has been pushed fully within the access slot to the sealing position, thereby totally closing the window 52, the small notch 110 at the end of the security plate engages the free end of the trip shaft lever 124. This action causes the lever to pivot from the position shown in FIG. 3 to the position shown in FIG. 5. The rotation of the trip shaft lever about its pivot 126 pulls the free end of the lock shaft to the position shown in FIG. 5. In this position the free end 148 of the lock shaft 120 is clear of the cam 118 on the cash box lock. With the free end 148 no longer blocking the cam, one can insert a key into the cash box lock 42, and rotate the lock so that the cam can be freed from locking engagement the slot 118A in the stacker apparatus housing 60A. In short, the cam can be rotated to the phantom line position shown in FIG. 1 so it no longer extends out through a wall of the housing 60A, but instead is fully within the cash box. In this position the cash box can then be pulled or slid out of the apparatus by merely grasping the cash box handle 40 and pulling on it.

The secure cash box can then be taken to have its contents emptied. During its transportation to the secure room, the security plate remains in place, and, in fact, cannot be removed from its window sealing position. Once the cash box is located within the secure room, the two currency removable locks 44 and 46 can be unlocked by use of appropriate keys. In particular the insertion of the keys enables the locks to be rotated to free their respective cams 150 from an associated stop bar 152 extending parallel to the front door of the cash box. Once the cams 150 of the two locks 44 and 46 are free of the stop bar 152, the front door 38 of the cash box can be pivoted downward to provide access to the stack of banknotes 50A within the box. The banknotes can then be removed, whereupon the spring biased support plate moves upward toward the top wall 36 of the cash box. The security plate can then be removed to reopen the cash box window 52.

In order to remove the security plate from the cash box, the free end 154 of the security bar shaft 142 is pushed to the rear against the bias of the spring 146 to a "retracted" position. Pressure is maintained on the free end 154 to hold the security bar in the retracted position. When the security bar is in the retracted position the pawl 136 is pivoted in the clockwise direction so that it exits from an associated notch in the rachet 134, as shown by the phantom lines in FIG. 5. One can then grasp the handle 104 of the security plate 12 and pull on it so that the security plate can be slid out of the access slot 92. In particular, since the pawl 136 is out of engagement with the rachet, the gear 130 is free to rotate in the clockwise direction in FIG. 5. Thus, as the plate is pulled out of the +slot, each succeeding aperture 106 of the security plate engages a succeeding tooth on the gear wheel to cause the gear wheel to rotate in the clockwise direction. When the last aperture 106 of the security plate is freed of any tooth of the gear, the security plate can be fully extracted from the access slot of the cash box.

Moreover, once the apertures of the security plate are free of the teeth of the gear 130, the free end 154 of the security bar shaft 142 can be released, thereby enabling the spring 146 to pull the shaft 142 forward. This action causes the pawl 136 to pivot about the pivot pin 138 to enter a notch in the rachet 134. Once this has occurred, the gear 130 is precluded from being rotated further in the clockwise direction, but can, as described above, be rotated in the counterclockwise direction. The door 38 of the cash box is then closed, i.e., pivoted upward, and the currency locks 44 and 46 rotated so that their cams reengage the stop bar 152.

The cash box is then pushed into the stacker apparatus housing 22 and once fully in place the cash box lock 42 is rotated to the lock position, whereupon the cam 118 enters slot 118A of the apparatus housing 60A. Since the security plate 12 is no longer in the slot 92 the bias spring 128 acting on the lower portion of the lock trip shaft lever 124 causes that lever to pivot back to the position shown in FIG. 3. Accordingly, the free end 148 of the lock shaft 120 will block the cam 118 on the cash box lock 42 to prevent unlocking of the cash box from the stacker apparatus housing until the security plate is reintroduced fully to the sealing position in the slot to close the cash box window as described above.

Operation of the stacker apparatus to provide access to the transporting mechanism 26, without exposing the contents of the cash box will now be described. With the cash box in place, like shown in FIG. 4, the note path access cover 60 is held in a locked or down position by the heretofore mentioned locking mechanism and the manual latch 90.

The locking mechanism is shown clearly in FIGS. 4, 6, 7 and 9 and denoted hereinafter by the reference numeral 156. That mechanism basically comprises a toothed wheel or gear 158 mounted for rotation on a shaft 160 projecting from a note path locking mechanism cowling 162. A rachet 164 is fixedly secured to the shaft and the gear. The teeth of the gear are arranged to enter the slot 100 in the top wall 36 of the cash box when the cash box is locked in place in the apparatus 22. A note path hinge bar or pawl 166 is mounted on a pivot pin 168 from cowling 162 and is arranged to be received within respective notches in the rachet when the gear is rotated. Also located within the cowling 162 is a generally L-shaped, note path trip bar 170. The trip bar 170 is mounted on a pivot pin 172 to pivot thereabout. The upper end of the trip bar includes a hook 174 which is arranged to trap a stud 176. The stud 176 projects inward from the inside surface of the note path access cover 60 and through a slot 162A in the cowling 162. The trip bar 170 is biased by a tension spring 178 secured adjacent the hook end 174 of the trip bar. The pawl 166 is biased into a rachet-engaging position by a tension spring 180 secured between it and a pin on the cowling 162. A note path hinge bar 184 is located within the cowling 162 and is mounted on a pivot shaft 184 to pivot with the cover 60. The lower end of the note path trip bar 170 extends out the bottom of the cowling 162 into the slot 100 in the top wall 36 of the cash box when the cash box is in place as shown in FIG. 4.

When the locking mechanism 156 is in the state shown in FIG. 4 the note path access cover 60 is precluded from being pivoted upward or opened by virtue of the hook 174 on the upper end of the trip bar trapping the stud 176 therein.

In order to release that mechanism, the security plate 12 must be retrieved from its storage slot 96 in the cash box. Once removed from the storage slot the security plate 12 is oriented in a "second" orientation so that the apertures 106 are facing toward the right and the instructional indicia "This Side Up For Note Path Access" face upward. The security plate is then be inserted in the security plate access slot 12 and pushed down the slot by pushing on the handle of the security plate. The long notch 112 in the edge opposite the apertures enables the security plate to be slid past the gear 130 in the cash box.

Figure 6:
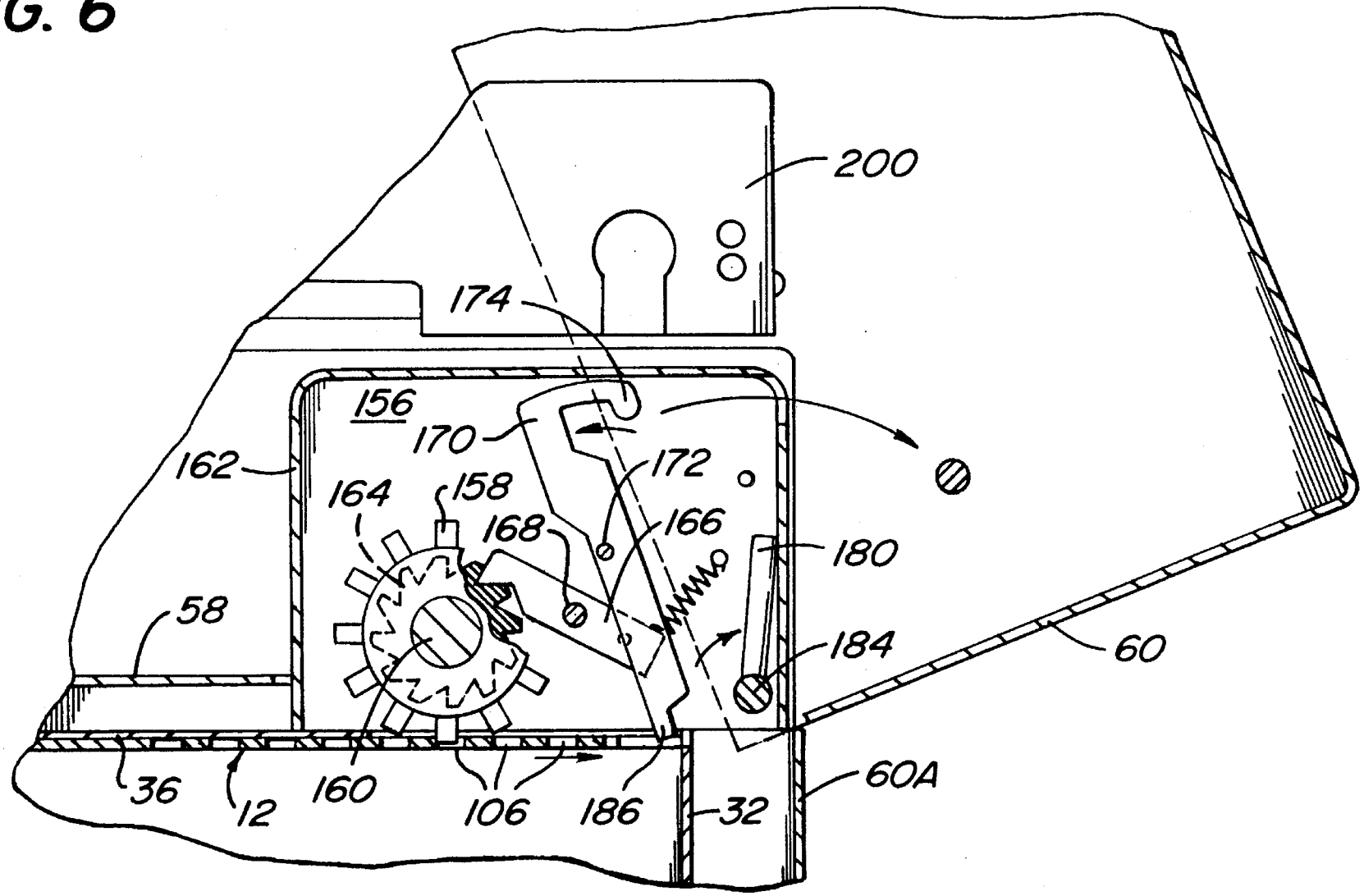
FIG. 6 is an enlarged, sectional view of a portion of the apparatus shown in FIG. 1.
Figure 7:
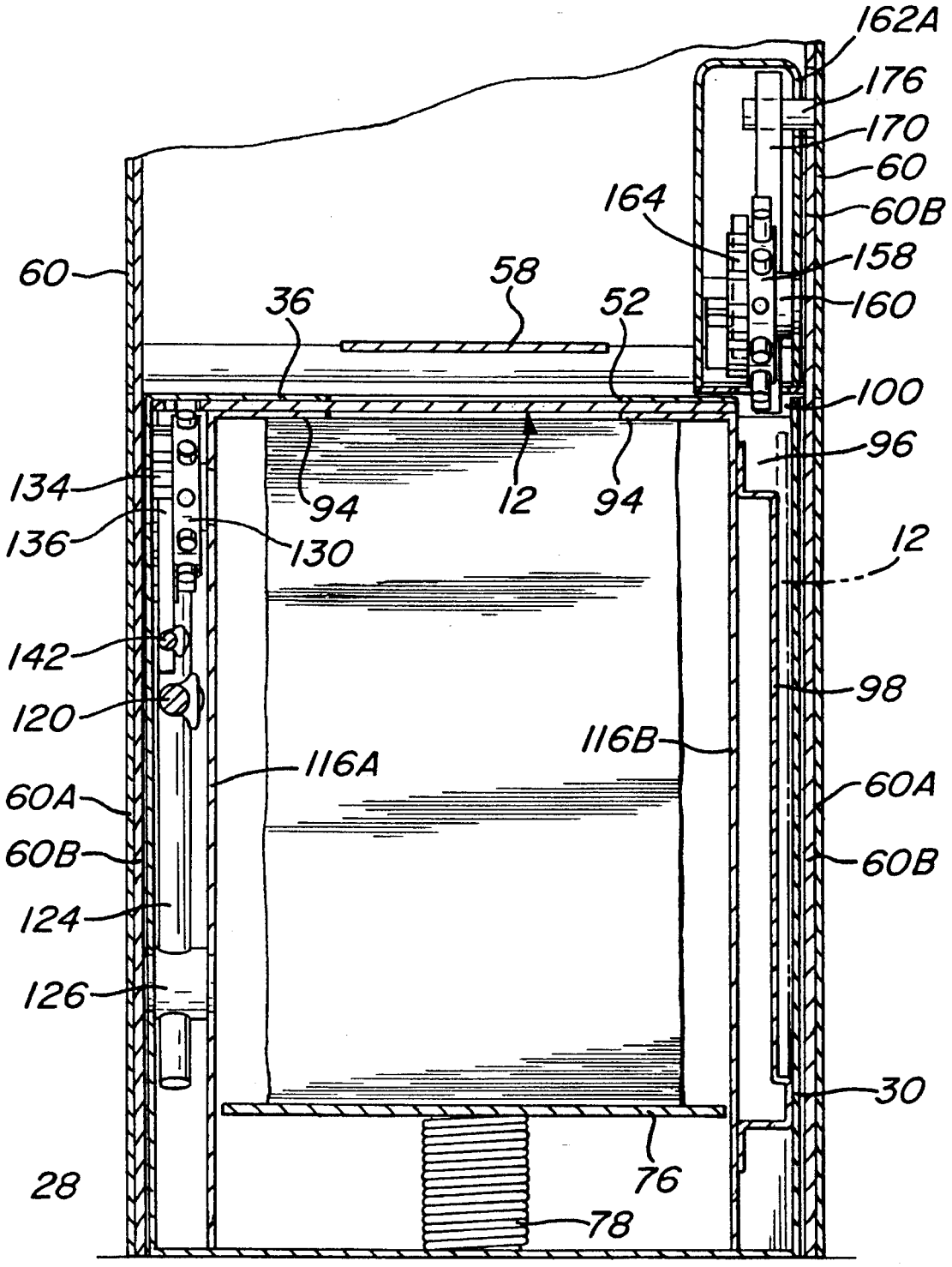
FIG. 7 is an enlarged, sectional view taken along line 7—7 of FIG. 3 but showing the security plate in a first orientation sealing position.

The plural apertures 106 on the edge of the security plate engage the teeth of the gear 158 under the cowling 162 to cause that gear to rotate in the counterclockwise direction as shown in FIGS. 4 and 6. The spring biased pawl does not interfere with this operation. However, should the security plate be attempted to be removed from the access slot 92 once one of its apertures has engaged a tooth of the gear, the spring biased pawl will preclude rotation of the gear in the counterclockwise direction. This action insures that once one of the apertures of the security plate is engaged by a tooth of the gear 158, the security plate cannot be removed from the cash box.

When the security plate 12 is pushed fully down the access slot 92 to the "sealing" position, the small notch 110 adjacent the first of the apertures 106 engages the free or lower end 186 of the note path trip bar 170. This action causes that bar to pivot in the counterclockwise direction about its pivot pin 172, thereby releasing the stud 176 from the hook 174. Once the stud is released, the note path access cover 60 can be pivoted upward as shown in FIG. 6 with the stud passing through the slot 162A in the cowling 162.

As noted earlier the note path hinge bar 182 pivots with the note path access cover 60. This action effects the release of the pawl 166 so that the biasing spring 180 causes the pawl to pivot into engagement with an associated notch in the rachet 164. In particular, the pivoting of the hinge bar 182 releases a pin 188 on the pawl, whereupon the spring rotates the pawl into engagement with the rachet notch. With the pawl engaging a rachet notch, the gear 158 is precluded from rotating in the clockwise direction. Accordingly, with the note path cover pivoted upward, that is open, thereby providing access to the transporter mechanism in the top of the cash box, the only thing precluding access to the currency within the interior of the cash box is the security plate 12 closing the window 52. The gear 156, being precluded from rotating in the clockwise direction, as viewed in FIG. 4, insures that the security plate cannot be pulled out of the access slot to open that window and provide access to the stack of banknotes within the cash box. It should also be noted that the note path cowling 166 prevents access to the locking mechanism 156 located therein so that that mechanism cannot be released when the access cover is pivoted open.

After the note path has been cleared of any obstruction, the cover can then be pivoted back downward. This action causes the note path hinge bar 182 to pivot downward, thereby engaging the pin 188 on the locking pawl 166. When this occurs the pawl is pivoted to the "release" position shown in FIG. 4. Once the pawl is released from the rachet, the gear 158 is freed so that the cash box security plate 12 can be pulled out of the slot 92. Once the plate is removed from the cash box, the window 52 in the top wall is open so that the cash box is ready to receive banknotes 50A from the transport mechanism 26. The security plate is then placed back in its side storage slot 96 until it is again called upon for use.

The controls, electronics, and power supply for the stacker apparatus 20 are located within a module designated by the reference numeral 200. The module 200 is mounted on the frame 60B as shown in FIG. 3.

Without further elaboration the foregoing will so fully illustrate our invention that others may, by applying current or future knowledge, adapt the same for use under various conditions of service.

We claim:

1. A secure currency stacker box for releasable mounting to paper currency handling apparatus, the paper currency handling apparatus including note acceptor means for validating a paper currency banknote inserted therein, and located within a openable cover for carrying the validated banknote into said stacker box, said stacker box being arranged to securely store a stack of paper currency banknotes therein and comprising a hollow member having a wall with an entrance window located therein through which a validated banknote is introduced by the punch plate of the apparatus, releasable securement means for releasably securing said box to the apparatus, and a releasably securable security plate, said security plate being arranged for disposition in a first orientation to be slid into said box to a sealing position to completely close said window, said security plate cooperating with said releasable securement means when said box is mounted in the apparatus to enable said box to be removed from the apparatus, with said security plate remaining in place completely closing said window, said security plate also being arranged for disposition in a second orientation when said box is secured to the apparatus to completely close said window while enabling the openable cover of the apparatus to be opened to provide access to the means for carrying the validated banknote into said stacker box.

2. The secure currency stacker box of claim 1 additionally comprising a lockable door on said box to provide access to the interior of said box, said door providing the only means of access to the interior of said box when said security plate is in place closing said window.

3. The secure currency stacker box of claim 1 wherein said security plate includes plural apertures therein and wherein said box includes a first gear located adjacent said window, said first gear being rotatable in a first direction and having teeth adapted to be engaged by said plural apertures as said security plate is slid into said box in said first orientation to close said window.

4. The secure currency stacker box of claim 3 additionally comprising first actuatable release means, and wherein said first gear is precluded by said first actuatable release means from rotating in a direction opposite to said first direction to preclude the removal of said security plate from said box once at least one of said teeth of said first gear has been engaged by one of said apertures in said cover plate.

5. The secure currency stacker box of claim 4 wherein said first actuatable release means is arranged when actuated for enabling said first gear to rotate in a direction opposite to said first direction to enable said security plate to be slid out of said box.

6. The secure currency stacker box of claim 1 wherein said security plate includes plural apertures therein and wherein the apparatus includes a second gear located within the openable cover of the apparatus, the second gear being located adjacent said note entrance opening when said box is secured to the apparatus, the second gear being rotatable in a first direction and having teeth adapted to be engaged by said plural apertures as said security plate is slid into said box in said second orientation to close said window, the second gear being coupled to the openable cover of the apparatus to enable the openable cover to be opened when said security plate completely closes said window.

7. The secure currency stacker box of claim 6 wherein the apparatus includes second actuatable release means coupled to the second gear, the second actuatable release means precluding the second gear from rotating in a direction opposite to said first direction to preclude the removal of said security plate from said box once at least one of said teeth of the second gear has been engaged by one of said apertures in said security plate.

8. The secure currency stacker box of claim 7 wherein said second actuatable release means is arranged when actuated for enabling said second gear to rotate in a direction opposite to said first direction to enable said security plate to be slid out of said box when the openable cover of the apparatus has been closed.

9. The secure currency stacker box of claim 1 wherein said box comprises a spring loaded plate for receipt of at least one banknote thereon.

10. Paper currency handling apparatus comprising a stacker box, banknote acceptor means for validating a paper currency banknote inserted in said note acceptor means, means located within a openable cover for carrying the validated banknote into said stacker box, said stacker box being arranged to securely store a stack of paper currency banknotes therein and comprising a hollow member having a wall with an entrance window located therein through which a validated banknote is introduced by said punch plate means, releasable securement means for releasably securing said box to said apparatus, and a releasably securable security plate, said security plate being arranged for disposition in a first orientation to be slid into said box to a sealing position to completely close said window, said security plate cooperating with said releasable securement means when said box is mounted in said apparatus to enable said box to be removed from said apparatus, with said security plate remaining in place completely closing said window, said security plate also being arranged for disposition in a second orientation when said box is secured to said apparatus to completely close said window while enabling said openable cover of said apparatus to be opened to provide access to said means for carrying the validated banknote into said stacker box.

11. The apparatus of claim 10 additionally comprising a lockable door on said box to provide access to the interior of said box, said door providing the only means of access to the interior of said box when said security plate is in place closing said window.

12. The apparatus of claim 10 wherein said security plate includes plural apertures therein and wherein said box includes a first gear located adjacent said window, said first gear being rotatable in a first direction and having teeth adapted to be engaged by said plural apertures as said security plate is slid into said box in said first orientation to close said window.

13. The apparatus of claim 12 additionally comprising first actuatable release means, and wherein said first gear is precluded by said first actuatable release means from rotating in a direction opposite to said first direction to preclude the removal of said security plate from said box once at least one of said teeth of said first gear has been engaged by one of said apertures in said cover plate.

14. The apparatus of claim 13 wherein said first actuatable release means is arranged when actuated for enabling said gear to rotate in a direction opposite to said first direction to enable said security plate to be said out of said box.

15. The apparatus of claim 10 wherein said security plate includes plural apertures therein and wherein said apparatus includes a second gear located within said openable cover of said apparatus, said second gear being located adjacent said note entrance opening when said box is secured to said apparatus, said second gear being rotatable in a first direction and having teeth adapted to be engaged by said plural apertures as said security plate is slid into said box in said second orientation to close said window, said second gear being coupled to said openable cover to enable said openable cover to be opened when said security plate completely closes said window.

16. The apparatus of claim 15 wherein the apparatus includes second actuatable release means coupled to said second gear, said second actuatable release means precluding said second gear from rotating in a direction opposite to said first direction to preclude the removal of said security plate from said box once at least one of said teeth of said second gear has been engaged by one of said apertures in said security plate.

17. The apparatus of claim 16 wherein said second actuatable release means is arranged when actuated for enabling said second gear to rotate in a direction opposite to said first direction to enable said security plate to be slid out of said box when the openable cover of said apparatus has been closed.

18. The apparatus of claim 10 wherein said box comprises a spring loaded plate for receipt of at least one banknote thereon.

* * * * *